US006398017B1

(12) United States Patent
Cafiero

(10) Patent No.: US 6,398,017 B1
(45) Date of Patent: Jun. 4, 2002

(54) CASE FOR GLASSES

(75) Inventor: Aldo Cafiero, Belluno (IT)

(73) Assignee: Studio Promozionali S.N.C., Belluno (IT)

( * ) Notice: Subject to any disclaimer, the term of this patent is extended or adjusted under 35 U.S.C. 154(b) by 0 days.

(21) Appl. No.: 09/787,611

(22) PCT Filed: Sep. 21, 1998

(86) PCT No.: PCT/EP98/05991

§ 371 (c)(1),
(2), (4) Date: May 18, 2001

(87) PCT Pub. No.: WO00/16656

PCT Pub. Date: Mar. 30, 2000

(51) Int. Cl.[7] ..... A45C 11/04
(52) U.S. Cl. ..... 206/6; 206/815; 220/826
(58) Field of Search ..... 206/5, 6, 815; 220/4.22, 4.23, 8, 315, 324, 326

(56) References Cited

U.S. PATENT DOCUMENTS 2,461,792 A * 2/1949 Weaver ..... 206/6
3,651,983 A * 3/1972 Haugen ..... 220/315
3,825,110 A * 7/1974 Halbich et al. ..... 206/6
5,261,582 A * 11/1993 Mathews et al. ..... 206/5
5,417,339 A * 5/1995 Liu ..... 220/326

FOREIGN PATENT DOCUMENTS

| | | | |
|---|---|---|---|
| EP | 0615707 | * | 9/1994 |
| FR | 1306254 | * | 9/1962 |
| FR | 2652562 | * | 4/1991 |
| GB | 2255767 | * | 11/1992 |

* cited by examiner

*Primary Examiner*—Jim Foster
(74) *Attorney, Agent, or Firm*—James Creighton Wray; Meera P. Narasimhan

(57) ABSTRACT

A case, particularly for glasses, or similar, consists of two hinged (3) stiff half-shells (1, 2). According to the invention, the two half-shells (1, 2) are shaped in such a way as to be able to progressively fit one into the other, when the case is in the closed condition, while having different reciprocal snap closing positions (9, 10) corresponding to different positions of progressive insertion of the one (2) into the other (1).

12 Claims, 9 Drawing Sheets

CASE FOR GLASSES

BACKGROUND OF THE INVENTION

The invention relates to a case for glasses, consisting of a larger half-shell and a smaller half-shell made both of stiff material as metal or plastic and linked together by a hinge in such a way as to allow the smaller half-shell to progressively insert into the larger half-shell when the case is in closed position, assuming a plurality of progressive deeper insertion positions, with snap-locking means provided at the front side of the case opposite to the hinge and consisting of a plurality of equally spaced projections or cavities which extend on the inner side of the-front wall of the larger half-shell parallelly to the free edge of this wall and correspond to the progressive insertion positions, and of a cog means which project outwardly on the free edge of the front wall of the smaller half-shell and co-operate with the projections or cavities as to snap-locking the two half-shells together in each of the progressive insertion positions, according to the pre-characterising part of claim 1.

A case of this kind but suitable for prepared foodstuff is known from the document GB 2 255 767. The cog means provided on the smaller half-shell of this known case and co-operating with the equally spaced projections or cavities of the larger half-shell are formed of a plurality of cogs or corrugations which extend to a great part of the perimeter of the case and particularly to the whole length of the front wall of the case. Therefore in each position (with the exception of the first) of the plurality of progressive deeper insertion positions, more than one cog of the smaller half-shell is engaged in the projections or cavities of the larger half-shell.

SUMMARY OF THE INVENTION

According to the characterising part of the claim 1, the present invention consists in the combination of the following features:

a) the cog means of the smaller half-shell comprise only one single cog, b) the single cog and the projections or cavities have a length shorter than the length of the corresponding front walls of the half-shells and are provided in coincident median strips of these walls, c) the cog-bearing front wall of the smaller half-shell has such an elastic deformability as to allow to be pushed inwardly for disengaging the cog from the projections or cavities, d) in a substantially central position in the outer side of the bottom wall of the smaller half-shell a grasping recess is provided which is dimensioned in such a way as to allow a finger of the hand to be at least partially housed therein, e) on the outer side of the front wall of the smaller half-shell outside the larger half-shell when the smaller half-shell is in the completely inserted position, a grasping extension is provided which projects beyond the front wall of the larger half-shell and allows to push inwardly the front wall of the smaller half shell also in its completely inserted position.

Further improvements of the invention form the subject of the dependent claims.

The characteristics of the invention will be more apparent from the following description of a non-limiting example, illustrated in the annexed drawings, in which:

DETAILED DESCRIPTION

Figure 1:
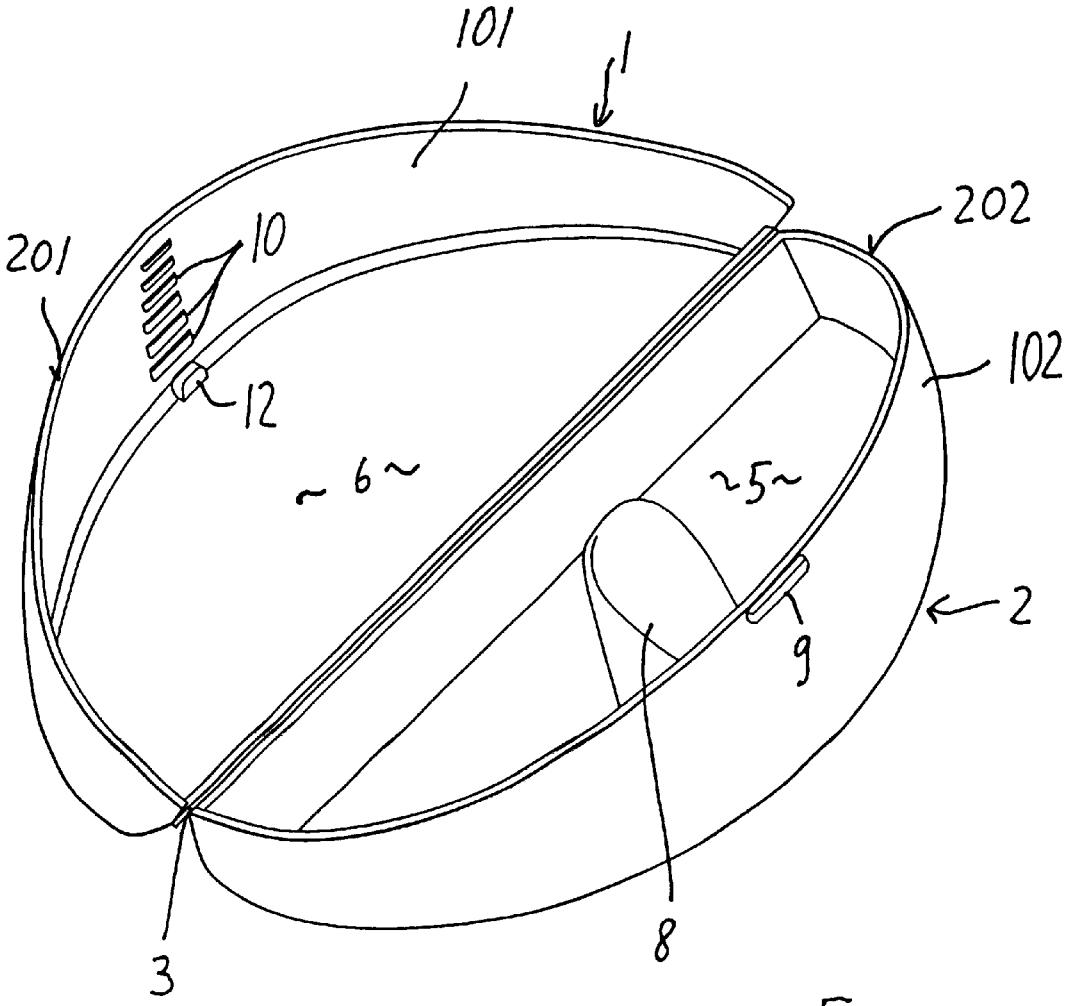
FIG. 1 is a perspective view of a first embodiment of the invention, in the open condition.

With reference to FIGS. 1 to. 5, the case according to the invention has two half-shells 1 and 2, preferably made of plastic.

The two half-shells 1, 2 have the shape of a sector or a segment of a sphere, spheroid or ellipsoid, the radii of curvature or the greater and smaller diameters of one of the two half-shells 1 being slightly greater than those of the other one 2. The two half-shells are hinged about an axis 3 which corresponds to a common chord connecting the opposite ends of the arched walls of the two half-shells 1, 2.

Particularly, the curvature in the radial direction, with respect to the hinging axis 3 substantially corresponds to a circular curvature.

On the hinging side, each half-shell is truncated, with a substantially plane wall 4, the hinging axis 3 between the two half-shells being provided along the edge of said rear plane wall 4, on the open side of the half-shell.

The rear plane wall 4 of the two half-shells may be also slightly inclined, in such a way that the two walls form an apex of an obtuse angle, at the hinging axis 3. This advantageously prevents the rear walls 4 from exerting a pressure action possibly such as to cause deformations on the glasses contained inside, when closing the case.

The radial closed walls 5, 6 of each half-shell are plane and form the bearing side and the upper side respectively.

In an appropriate position, in the plane wall 5 of one of the two half-shells, i.e. the bearing half-shell 2, there is provided a substantially central recess 7, which forms a projection 8, on the inner side, being meant to engage under the nose-piece of the glasses frames instead of the nose, whereas the glasses are disposed with their lower side turned towards the curved wall and with their upper side in the area of the straight hinging side of the two half-shells.

The recess 7 and the corresponding protrusion 8 have a substantially cylindrical shape and terminate with an inclined and rounded bottom.

As shown in FIG. 1, this protrusion 8, as well as the rear wall 4 allow to keep the glasses in a slightly inclined position, which is suitable for displaying them, the case being therefore a useful glasses displaying device.

At the center of the free edge of the arched wall of the smaller half-shell 2, there is provided an outwardly projecting cog 9. In a coincident position on the inner side of the arched wall of the larger half-shell 1, there is provided a line of parallel spaced protrusions or projections 10, which are all oriented parallel to the cog 9.

Figure 2:
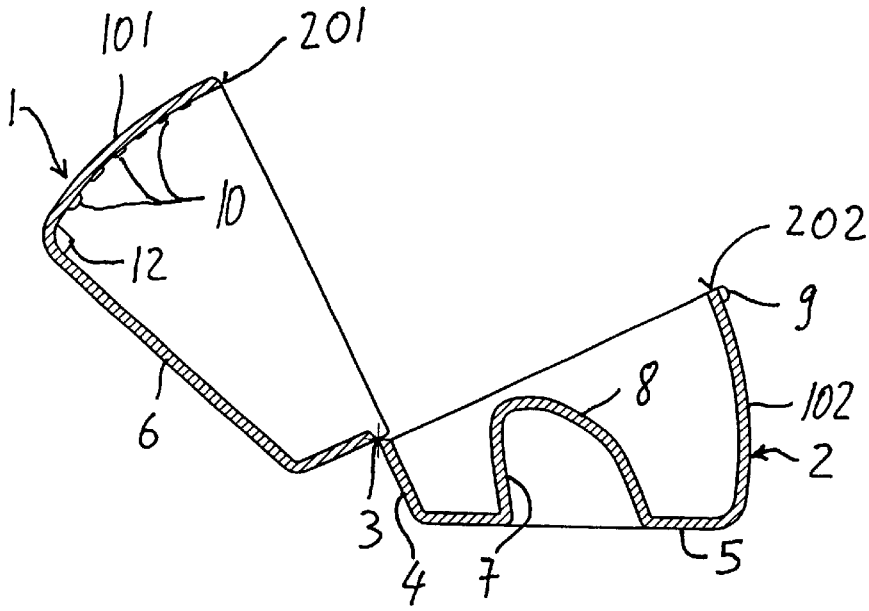
FIGS. 2 to 4 are different cross sectional views of the case as shown in FIG. 1, in the open condition, closed at the first snap and completely closed.
Figure 3:
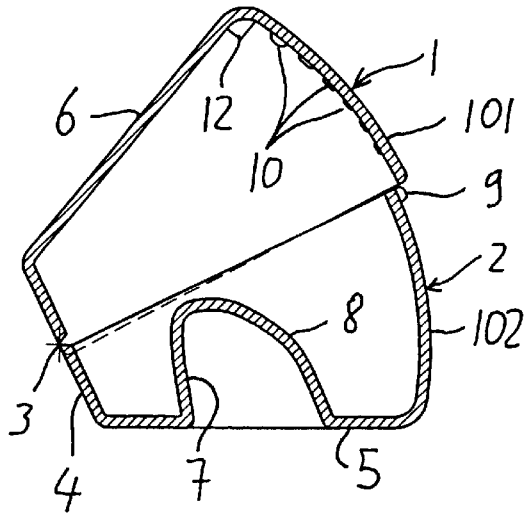
Figure 4:
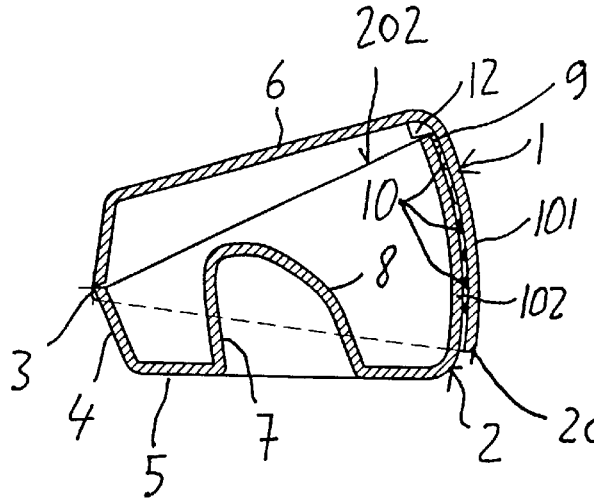

Thanks to this construction, the two half-shell parts 1, 2 fit one into the other in the closed condition, as shown in the figures and may be releasably locked in a plurality of relative progressive deeper penetration positions, as shown in FIGS. 2 to 4. In this manner, the containing capacity of the case may be varied simply, while always maintaining an attractive look and always ensuring a good protection of the contents.

Snap after snap, the two half-shells are brought from a first closing position, in which the case has the highest housing capacity (FIG. 3) to the totally closed position (FIG. 4), in which the two half-shells are totally pushed the one inside the other.

Obviously, the case of the present invention may be also used for other purposes, alternative to the use for glasses.

Although the use of plastic is preferable, it is also possible to use other materials, such as particularly metal sheets, or similar for its fabrication.

Inside, at least on the walls of the lower half-shell 2, one or more layers of padding or lining material may be fixed.

Figure 5A:
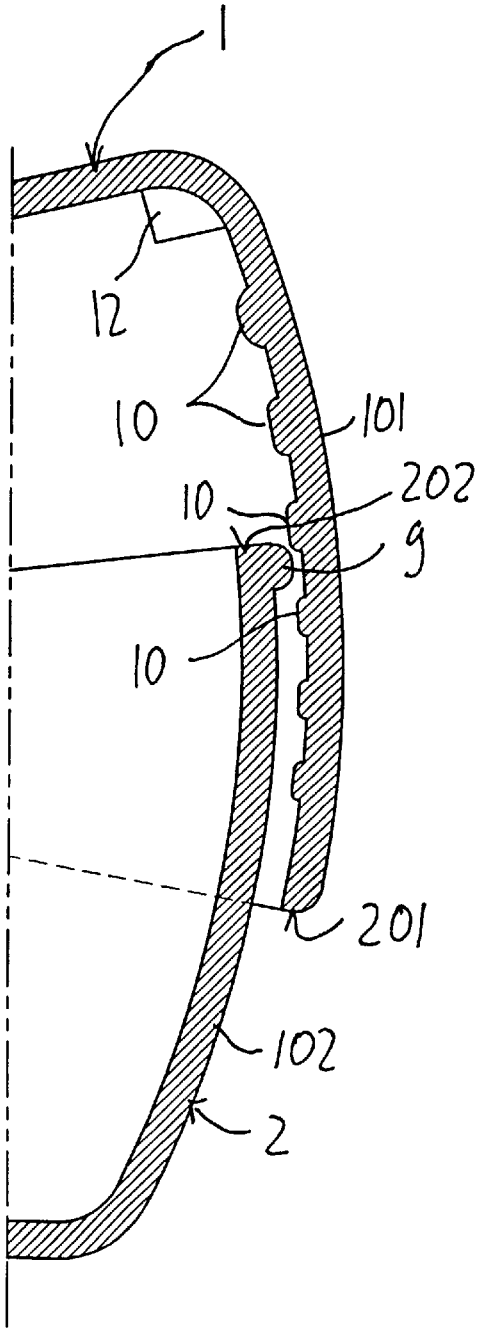
FIGS. 5A and 5B are enlarged cross sectional views of the region of the line of projections and of the engaging cog in the case as shown in FIG. 1.
Figure 5B:
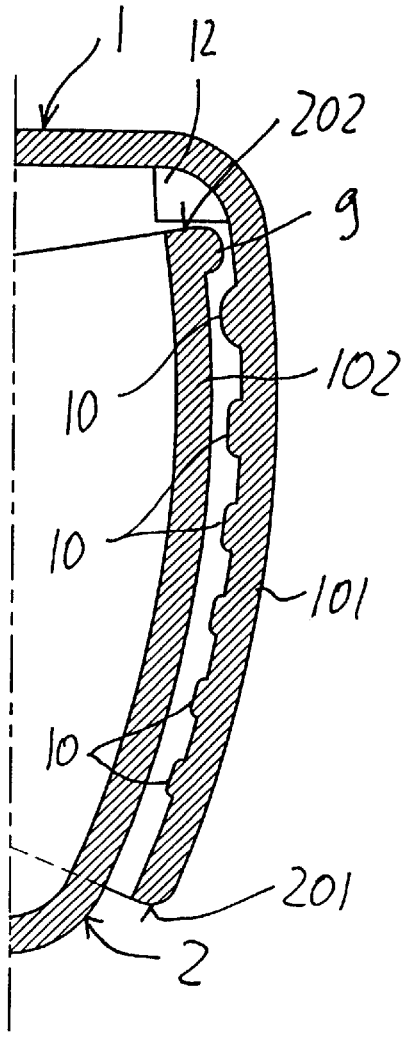
Figure 11:
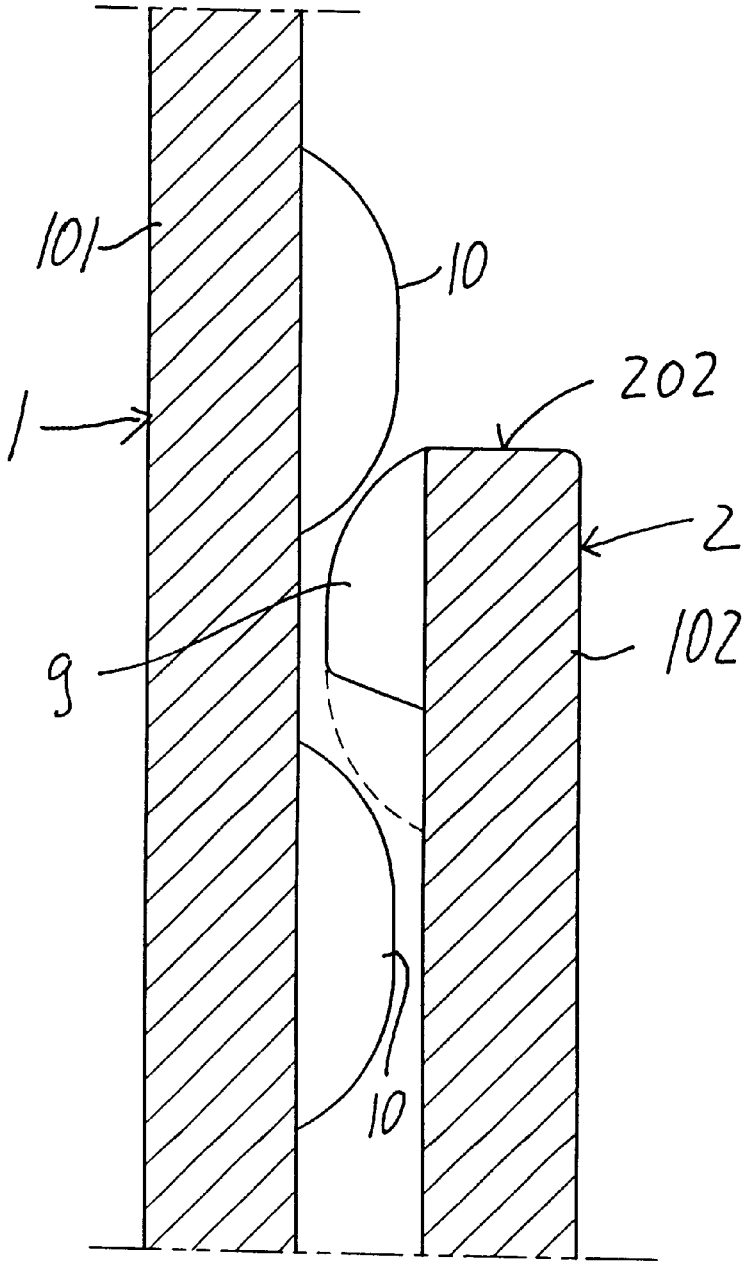
FIG. 11 is a view like that shown in FIG. 10, with the cog engaged in the line of projections, when no pressure is exerted on the grasping extension.
Figure 12:
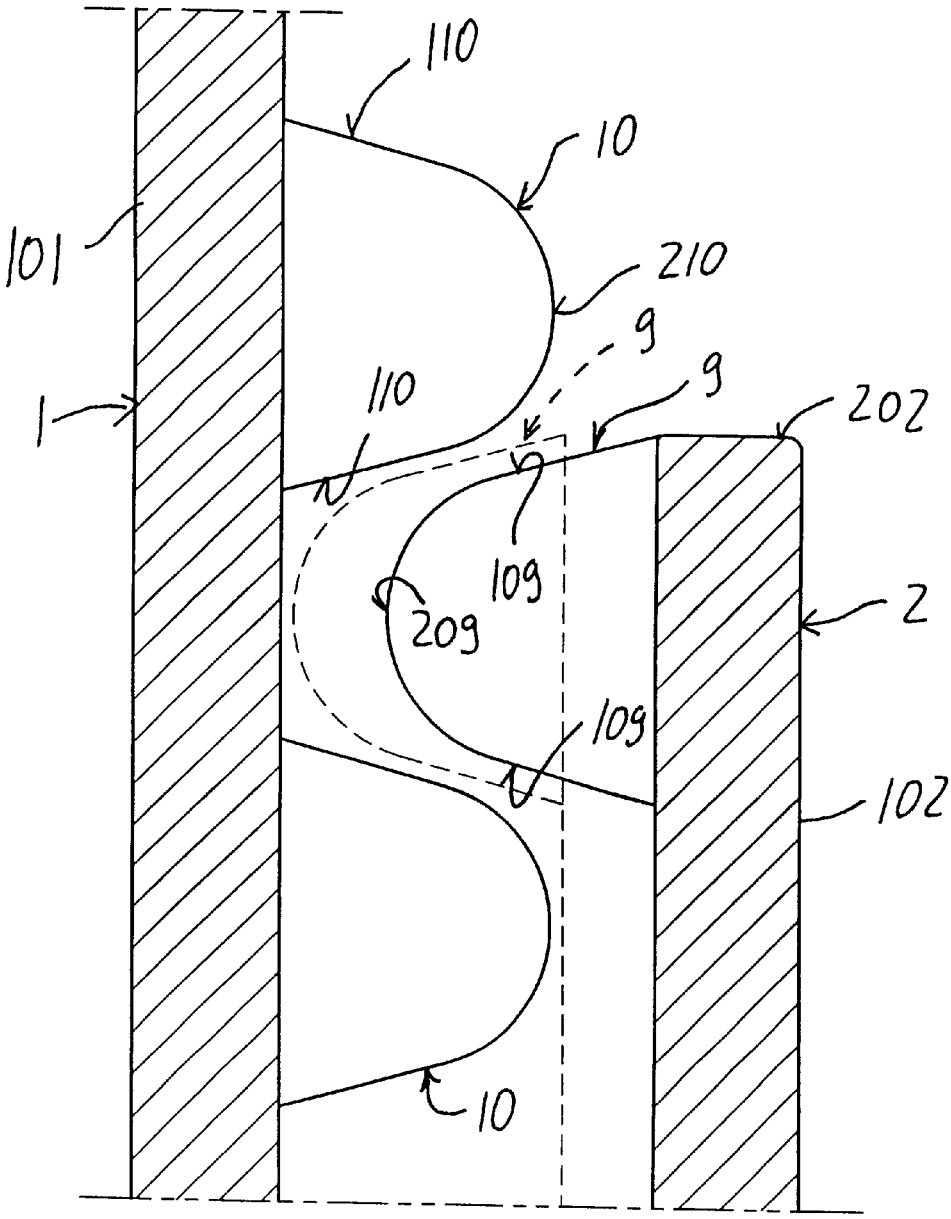
FIG. 12 is a side view like that shown in FIG. 11, with the cog moved partially apart from the line of projections, with pressure being exerted on the grasping extension, whereas, in dotted lines, the cog is shown in the complete engagement position.

FIG. 5 and more precisely FIG. 11 show the conformation of the projections 10, which is such, that they have a markedly rounded cross section, having the shape of a cylindrical sector, particularly semielliptical or lune-shaped, with low-slope faces. This is provided to allow the cog 9 to harmonically slip along the line of projections. The cog is also markedly rounded, not sharply pointed and with low-slope faces.

The cog 9 may also be markedly rounded, at least on one face thereof, and in this case on that facing the closing direction, whereas the opposite face is steep.

This arrangement may be applied also to the aligned projections 10, alternatively or in combination and for faces equal to or different from those of the cog 9.

By this arrangement, the two half-shells slip through several snaps the one in relation to the other, while automatically making use of the intrinsic elasticity of the material.

Figure 6:
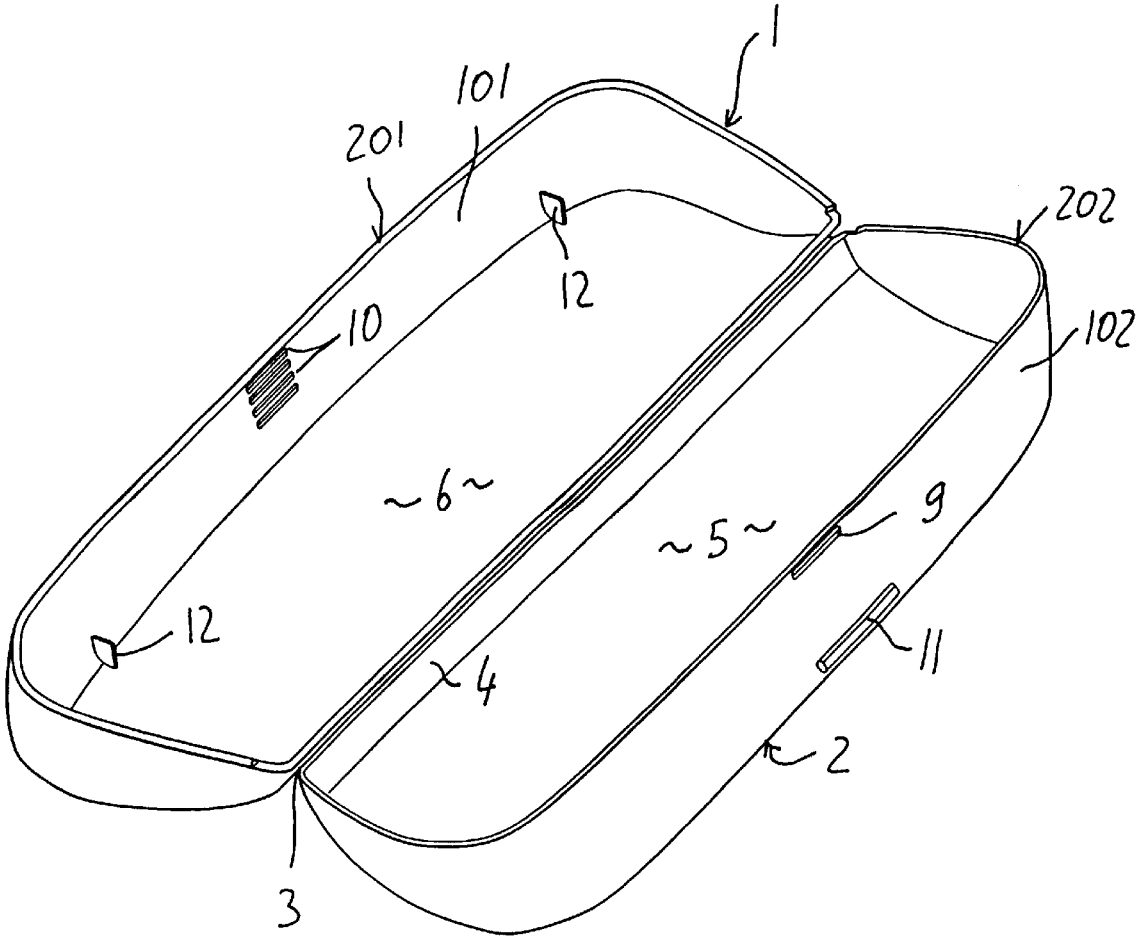
FIG. 6 is a perspective view of a second embodiment of the case according to the invention.
Figure 7:
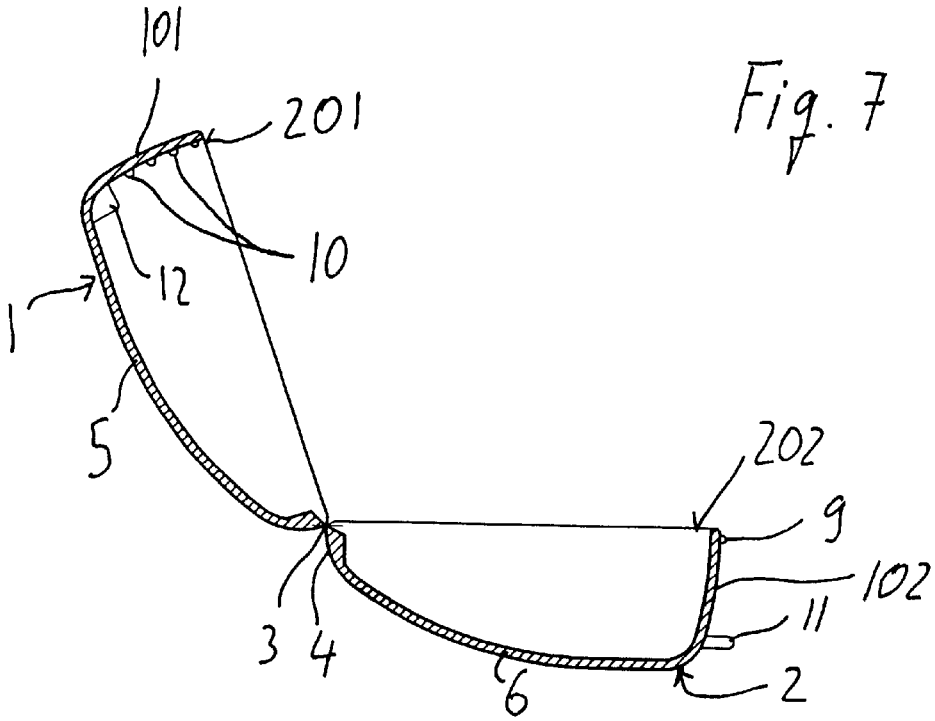
FIGS. 7 to 9 are cross sectional views like those shown in FIGS. 2 to 4 of the case of FIG. 6.
Figure 8:
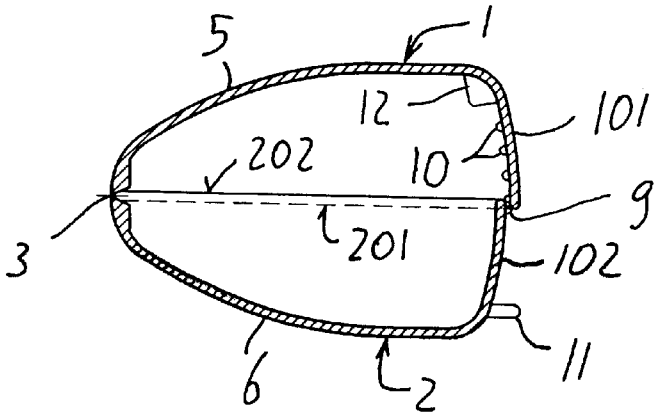
Figure 9:
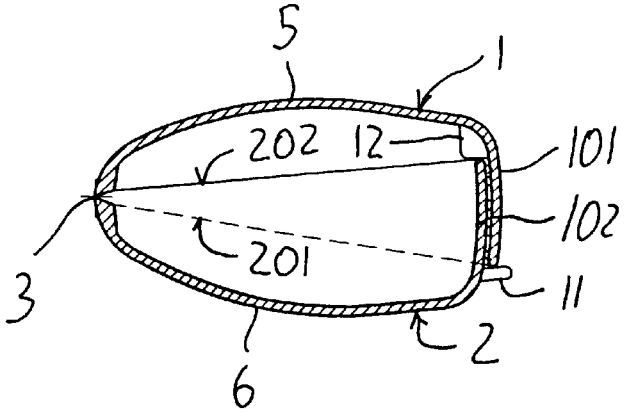
Figure 10A:
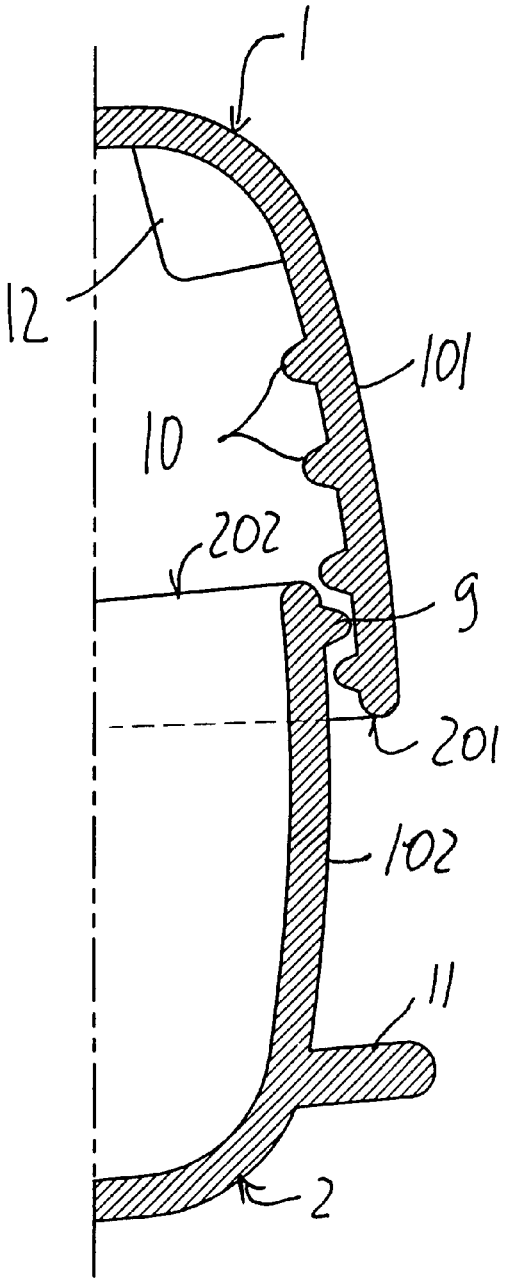
FIGS. 10A and 10B show an enlarged detail like that shown in FIGS. 5A and 5B of the case of FIG. 6.
Figure 10B:
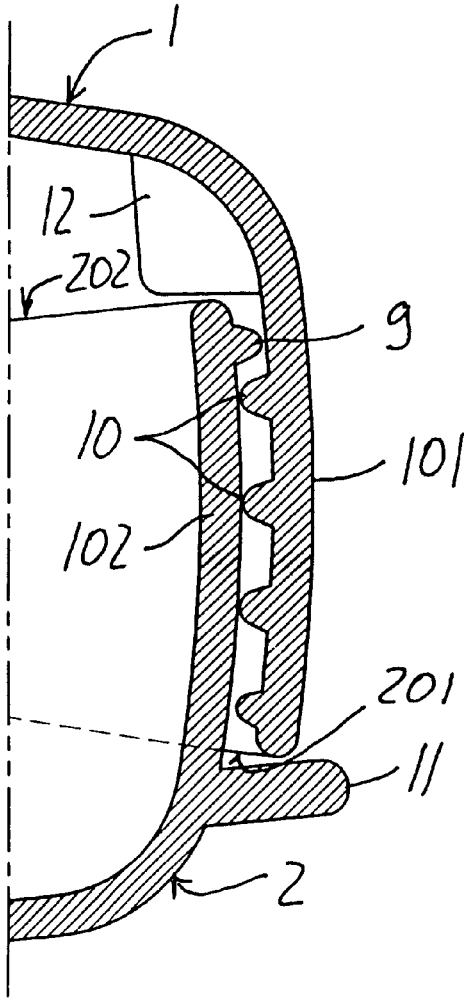

FIG. 6 shows a variant embodiment of the case according to the invention which, besides having a more traditional shape, has further characteristics with respect to the line of projections 10 and to the cog 9.

Also referring to the remaining FIGS. 7 to 12, at the front side 201 of the smaller half-shell, and outside the larger half-shell 1, when said smaller half-shell is in the totally inserted position, on said front side 102 there is provided a grasping extension or a push-button 11, projecting beyond the front side 10 of the larger half-shell when the case is in the closed condition.

This grasping extension 11 extends parallel to the free edge 201 of the larger half-shell 1 and to that 202 of the smaller one 2, and is made like a rib having a certain length.

This grasping extension is, at the same time, a push-button to be pressed inwards and backwards from the front side 102 of the smaller half-shell, i.e. acting towards disengagement or partial disengagement of the cog 9 from the line of projections 10. Therefore, advantages are obtained from providing said grasping extension 11 in the strip substantially coinciding with the cog 9 and with the line of projections 10 on the opposite half-shell 1.

Particularly, advantages may be obtained if the cog 9, the line of projections 10 and the grasping extension 11 are provided in the coincident median strips of the peripheral front walls 101, 102 of the two half-shells 1, 2.

The grasping tab 11 is also advantageously an end-of-stroke abutment in the mutual insertion of the two half-shells 1, 2. Said end-of-stroke abutment is advantageously assisted by projections, wings, ribs, blocks or end-of-stroke abutment extensions 12, which are provided inside the larger half-shell 1, and interact with the free front edge 202 of the smaller half-shell 2.

Said internal abutments 12 may be damped by providing that an abutment surface thereof is elastically compliant. Advantageously, this is obtained by disposing thereon a layer of elastic material, particularly foam, preferably made of the same padding lining material.

Preferably, these internal end-of-stroke abutments 12 are at least two in number and are disposed substantially symmetrically to the median vertical plane at the two opposite end areas of the front wall 101 of the larger half-shell 1, inside it.

This embodiment allows to exert pressure to disengage or at least partially disengage the cog 9 from the line of projections 10, thanks to the elastic deformability of the walls 102, in this case of the smaller half-shell 2, since, thanks to the grasping extension 11, it is possible to move the cog 9 and the line of projections 10 slightly apart from each other, thereby providing softer opening and closing movements, when the cog 9 is slipped all through the line of projections 10.

In this case, both the cog 9 and the aligned projections 10 are made with much steeper faces 109, 110 (see FIGS. 10 and 12) at least at their base, whereas they are chamfered, arched and rounded, at the apices 209, 210 of the cog 9 and of the projections 10, with surfaces whose radius is constant or progressively decreasing towards the apex of the cog 9 and of the projections 10. The depth of the cogs 9 is also greater and their steeper faces allow to provide shorter distances between the projections 10 and therefore a greater number of cogs all through the linear length of the line, hence a greater number of intermediate positions.

The conformation of the faces may also be asymmetrical, like in the previous embodiment, either for the cog 9 only, or for the projections only, or in such a way as to assist the reciprocal slipping motion of the cog 9 and of the line of projections 10 in one of the two case closing or opening directions. The asymmetries may be applied to identical or opposite faces of the cog 9 and of the projections 10.

Thanks to the particular construction of these cogs 9 and projections 10, a stronger engagement force is ensured in the closed positions, particularly in the positions other than the penetration end-of-stroke. The grasping extension 11 allows to partially move the line of projections 10 apart from the cog 9, at least to a partial extent, such that the aligned projections 10 and the cog 9 can cooperate by their respective rounded parts 209, 210, thereby obtaining a more harmonic and easier slipping motion of the two half-shells from the closed to the opening positions.

As disclosed above, this movement of the cog 9 apart from the line of projections 10 towards partial disengagement therefrom may occur when the user presses the grasping extension 11 which acts as a push-button, thanks to the intrinsic elasticity of the material.

The elasticity and the compliance of the wall region associated to the cog 9 and to the grasping extension 11 or to the push-button may be calibrated by any method, and without weighing heavily on production costs. These arrangements may comprise the provision of a lower wall thickness on the part of the front wall 102 of the half-shell 2 where the cog 9 and the grasping extension 11 or the push-button are provided.

Alternatively, said wall region may be connected to the rest of the wall 102 by a hinging zone or line, made through a wall weakening or thinning line provided at said hinging zone or line.

A further variant may consist in that, by providing co-injection molds, the wall region associated to the cog 9 or to the grasping extension 11, or the hinging zone or line are made of different materials, with different deformability and elasticity characteristics, during the same molding process for the whole case.

In order to be able to retain the larger half-shell, without deforming it under pressure so as to partially reduce the moving apart action caused by the inward pressure of the grasping extension 11 or of the push-button associated to the smaller half-shell 2, it is also possible to calibrate the elasticity of the larger half-shell 1, at least in the region of the line of projections 10 in such a way that it is less deformable than the corresponding region of the smaller half-shell 2. Also in this case, this may be provided by means of any stiffening arrangements, such as a thicker wall at least in the region of the line of projections, or through the whole front wall 101 of the larger half-shell 1 of the larger half-shell, the provision of internal or external stiffeners like ribs, or else, the co-injection production of said region from a different material, for example less flexible of said region.

Although the above description relates to the larger half-shell 1 bearing the line of projections 10 and the smaller half-shell 2 bearing the cog 9 with the grasping extension 11 or the push-button, the above arrangements and advantages are obtained in the same way if the line of projections 10 is alternatively provided in combination with the grasping extension 11 or the push-button on the smaller half-shell 2 and the cog 9 is provided on the larger half-shell 1.

It is also possible to provide an additional line of projections and an associated cog at another location of the front walls of the half-shells, for example two lines of projections 10, each with its corresponding cog 9, which are disposed symmetrically with respect to a median transverse point of the case.

The invention is not intended to be limited to the embodiments described and illustrated herein, but may be greatly varied, especially as regards construction. According to a possible variant, instead of one single cog 9, interacting with a line of projections 10, there may be provided a line of cogs 9 similar to the line of projections 10 and interacting therewith. This line of cogs may be composed of at least two adjacent cogs 9. In this way, particularly when no means are provided to disengage at least partially the cogs 9 from the line of projections 10, the profiles of the cogs and of the projections may be further flattened, i.e. provided with even less steep faces.

Figure 13:
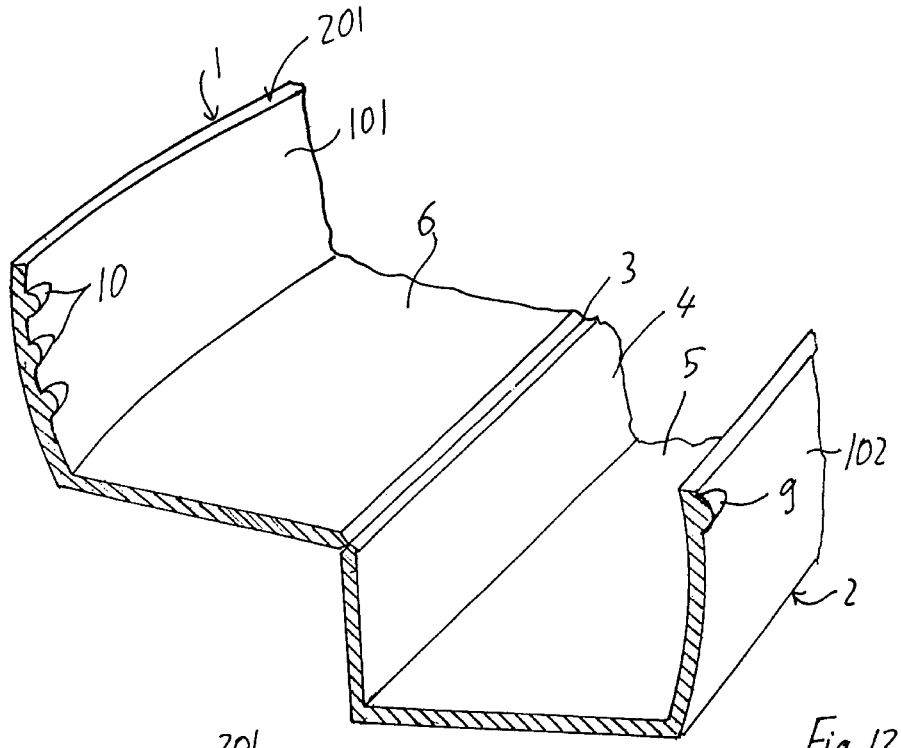
FIGS. 13 and 14 are cross sectional perspective views of two further embodiments according to the invention.
Figure 14:
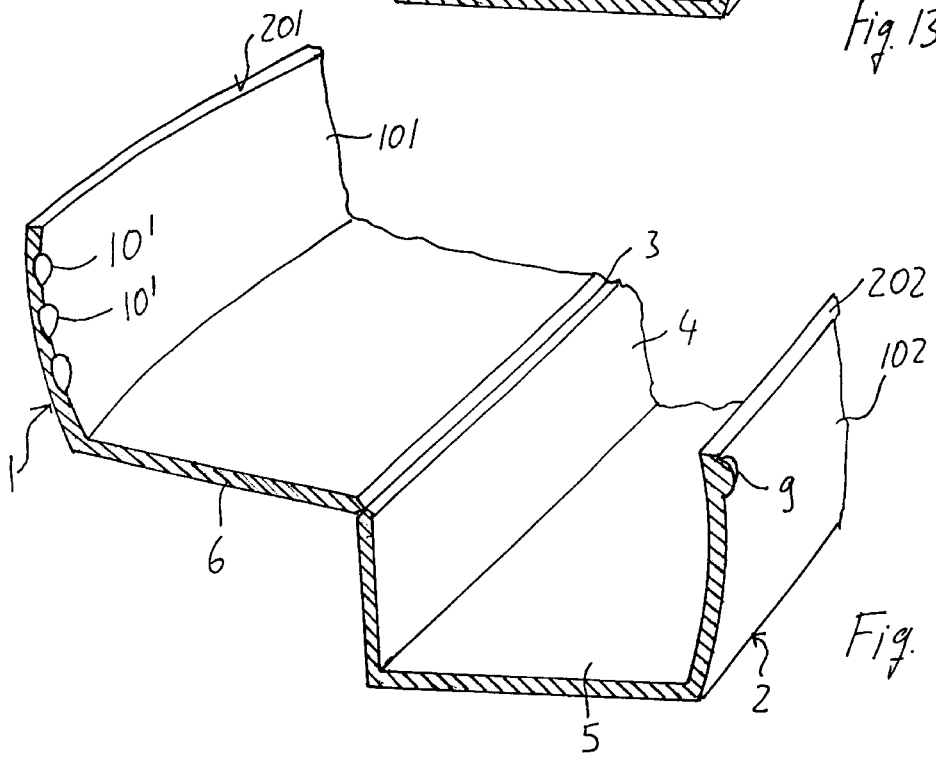

A further variant embodiment, shown in detail, provides lens- or dome-shaped elements, such as buttons or similar, having a circular or ovoidal or elliptical plan, instead of the cog/s and/or of the projections on the two half-shells. In this case, as shown in FIG. 13 with reference to an elliptical plan, both the projections and the cog protrude. Conversely, in the case of FIG. 14, in which a tooth having a circular plan is shown, said projections consist of complementary cavities 10' or depressions formed in the wall of their respective half-shell. These two constructions provide the advantage that a sufficient locking effect is ensured in the reciprocal position of the two half-shells, a softer relative movement being also provided when the cog slips along the line of projections or cavities. The embodiment with cavities provides a lower material consumption and manufacturing advantages, as compared with the embodiment of FIG. 13. For both embodiments, the curvature of the cog and of the projections or cavities, particularly as considered in the slipping direction of the cog through the line of projections or cavities, may be either constant or variable according to the desired higher or lower mutual engagement force, or to the softer or harder mutual slipping motion of the two half-shells through the different closing positions. The curvature transverse to the slipping direction may also affect to a certain extent the joint resistance and the slipping softness.

All this without departure from the guiding principle of the invention, disclosed above and claimed below.

I claim:

1. A case for glasses, consisting of a larger half-shell (1) and a smaller half-shell (2) made both of stiff material as metal or plastic and linked together by a hinge (3) in such a way as to allow the smaller half-shell (2) to progressively insert into the larger half-shell (1) when the case is in closed position, assuming a plurality of progressive deeper insertion positions, with snap-locking means provided at the front side of the case opposite to the hinge (3) and consisting of a plurality of equally spaced projections (10) or cavities (10') which extend on the inner side of the front wall (101) of the larger half-shell (1) parallelly to the free edge of this wall and correspond to the progressive insertion positions, and of a cog means (9) which project outwardly on the free edge of the front wall (102) of the smaller half-shell (2) and co-operate with the projections (10) or cavities (10') as to snap-locking the two half-shells (1, 2) together in each of the progressive insertion positions, characterised by the combination of the following features:

a) the cog means of the smaller half-shell (2) comprise only one single cog (9), b) the single cog (9) and the projections (10) or cavities (10') have a length shorter than the length of the corresponding front walls (101, 102) of the half-shells (1, 2) and are provided in coincident median strips of these walls, c) the cog-bearing front wall (102) of the smaller half-shell (2) has such an elastic deformability as to allow to be pushed inwardly for disengaging the cog (9) from the projections (10) or cavities (10'), d) in a substantially central position in the outer side of the bottom wall (5) of the smaller half-shell (2) a grasping recess (7) is provided which is dimensioned in such a way as to allow a finger of the hand to be at least partially housed therein, e) on the outer side of the front wall (102) of the smaller half-shell outside the larger half-shell (1) when the smaller half-shell (2) is in the completely inserted position, a grasping extension (11) is provided which projects beyond the front wall (101) of the larger half-shell (1) and allows to push inwardly the front wall (102) of the smaller half shell (2) also in its completely inserted position.

2. A case according to claim 1, characterised in that the grasping extension (11) extends parallel to the free edge (201) of the front wall (101) of the larger half-shell (1) and to the free edge (202) of the front wall (102) of the smaller half-shell (2) and is made in the form of a rib or wing.

3. A case according to claim 1, characterised in that the grasping extension (11) is also an abutment for the free edge of the front wall (101) of the larger half-shell (1) in the completely inserted position of the two half-shells (1, 2).

4. A case according to claim 1, characterised in that the whole front wall (102) of the smaller half-shell (2) is made of elastically deformable material.

5. A case according to claim 1, characterised in that the portion of the front wall (102) of the smaller half-shell (2) whereon the cog (9) and the grasping extension (11) are provided is thinner than the rest of this wall.

6. A case according to claim 1, characterised in that the portion of the front wall (102) of the smaller half-shell (2) whereon the cog (9) and the grasping extension (11) are provided is connected to the rest of the wall (102) by means of a hinging area or line.

7. A case according to claim 6, characterised in that the hinging area or line is made of a weakening or thinning area or line of the wall thickness.

8. A case according to claim 6, characterised in that the hinging area or line is made of a material having deformability and elasticity characteristics different from those of the rest of the wall (102).

9. A case according to claim 1, characterised in that the whole portion of the front wall (102) of the smaller half-shell (2) whereon the cog (9) and the grasping extension (11) are provided is made of a different from those of the rest of the wall (102).

10. A case according to claim 1, characterised in that at least the portion of the front wall (101) of the larger half-shell (1) whereon the projections (10) or the cavities (10') are provided is less deformable than the corresponding portion of the front wall (102) of the smaller half-shell (2).

11. A case according to claim 10, characterised in that at least the portion of the front wall (101) whereon the projections (10) or the cavities (10') are provided has stiffening ribs.

12. A case according to claim 10, characterised in that at least the portion of the front wall (101) whereon the projections (10) or the cavities (10') are provided is made of a material less flexible than the rest of the wall.

* * * * *